US011594365B2

(12) United States Patent
Igarashi et al.

(10) Patent No.: US 11,594,365 B2
(45) Date of Patent: Feb. 28, 2023

(54) COIL COMPONENT AND METHOD FOR MANUFACTURING THE SAME

(71) Applicant: Murata Manufacturing Co., Ltd., Kyoto-fu (JP)

(72) Inventors: Yuuji Igarashi, Nagaokakyo (JP); Akio Igarashi, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 381 days.

(21) Appl. No.: 16/849,903

(22) Filed: Apr. 15, 2020

(65) Prior Publication Data

US 2020/0373076 A1 Nov. 26, 2020

(30) Foreign Application Priority Data

May 23, 2019 (JP) ..... JP2019-096445

(51) Int. Cl.
*H01F 27/29* (2006.01)
*H01F 27/30* (2006.01)
*H01F 41/10* (2006.01)

(52) U.S. Cl.
CPC ..... *H01F 27/292* (2013.01); *H01F 27/306* (2013.01); *H01F 41/10* (2013.01)

(58) Field of Classification Search
CPC ..... H01F 27/292; H01F 27/306; H01F 41/10
See application file for complete search history.

(56) References Cited

U.S. PATENT DOCUMENTS 6,472,969 B1 * 10/2002 Hanato ..... H01F 17/045 336/200
2005/0237141 A1 * 10/2005 Hirai ..... H01F 27/292 336/83
2006/0267719 A1 * 11/2006 Yasuda ..... H01F 17/045 336/223

(Continued)

FOREIGN PATENT DOCUMENTS

JP 2015-050373 A 3/2015
JP 2019-009285 A 1/2019

OTHER PUBLICATIONS

An Office Action; "Notice of Reasons for Refusal," mailed by the Japanese Patent Office dated Oct. 26, 2021, which corresponds to Japanese Patent Application No. 2019-096445 and is related to U.S. Appl. No. 16/849,903 with English translation.

*Primary Examiner* — Elvin G Enad
*Assistant Examiner* — Malcolm Barnes
(74) *Attorney, Agent, or Firm* — Studebaker & Brackett PC

(57) ABSTRACT

A coil component includes a wire; a core having a winding core around which the wire is wound and a flange portion provided at an end portion of the winding core in an axial direction; and a terminal electrode to which the wire is connected and that is provided on the flange portion. The terminal electrode has a projecting portion that sticks out in the axial direction relative to the flange portion. The projecting portion has a flat surface along which the wire is thermocompression-bonded. Thermocompression bonding of the wire is performed in a state where an interval between a head surface of a heater chip and the flat surface becomes narrower from a flange portion side toward a front end side of the projecting portion. A degree of crushing of the wire decreases from the front end side toward the flange portion side of the projecting portion.

20 Claims, 9 Drawing Sheets

(56) References Cited

U.S. PATENT DOCUMENTS

| | | | | |
|---|---|---|---|---|
| 2008/0003865 | A1* | 1/2008 | Hatakeyama | H01F 17/045 439/399 |
| 2009/0273426 | A1* | 11/2009 | Urabe | H01F 41/076 29/606 |
| 2013/0048616 | A1* | 2/2013 | Morimoto | H01F 41/10 219/121.64 |
| 2017/0025212 | A1* | 1/2017 | Jerez | H01F 41/07 |
| 2017/0288626 | A1* | 10/2017 | Kobayashi | H01F 27/006 |
| 2017/0316873 | A1* | 11/2017 | Igarashi | H01F 27/2828 |
| 2018/0330869 | A1* | 11/2018 | Kim | H01F 27/2823 |
| 2018/0374631 | A1 | 12/2018 | Igarashi et al. | |
| 2019/0148055 | A1* | 5/2019 | Moriya | H01F 27/2823 336/83 |
| 2019/0189320 | A1* | 6/2019 | Takagi | H01F 27/2828 |

* cited by examiner (1)

(2)

(3)

(1)

(2)

(3)

COIL COMPONENT AND METHOD FOR MANUFACTURING THE SAME

CROSS-REFERENCE TO RELATED APPLICATION

This application claims benefit of priority to Japanese Patent Application No. 2019-096445, filed May 23, 2019, the entire content of which is incorporated herein by reference.

BACKGROUND

Technical Field

The present disclosure relates to a coil component and a method for manufacturing the coil component. More specifically, the present disclosure relates to a coil component in which a wire and a terminal electrode are connected by thermocompression bonding and a method for manufacturing the coil component.

Background Art

For example, Japanese Unexamined Patent Application Publication No. 2015-50373 describes a technique related to the present disclosure. Japanese Unexamined Patent Application Publication No. 2015-50373 describes a coil component in which a wire and a terminal electrode are connected by thermocompression bonding. FIG. 12 is citation from Japanese Unexamined Patent Application Publication No. 2015-50373 and corresponds to FIG. 8(b) in Japanese Unexamined Patent Application Publication No. 2015-50373. FIG. 12 is for explaining a thermocompression bonding step and illustrates a part of a drum-shaped core 72 of a coil component 71.

The drum-shaped core 72 has a winding core 74 around which a wire 73 is spirally wound. A first flange portion and a second flange portion are provided at a first axial end portion and a second axial end portion of the winding core 74 that are opposite to each other, although only one flange portion 75 is illustrated in FIG. 12. A terminal electrode 76 made of a metal plate extending in a substantially L shape is attached to the flange portion 75. To the terminal electrode 76, an end portion of the wire 73 extended from the winding core 74 is connected.

Thermocompression bonding by using a heater chip 77 is applied to connect the wire 73 to the terminal electrode 76. As illustrated in FIG. 12, the heater chip 77 is disposed so as to face the terminal electrode 76 with the wire 73 interposed therebetween. In this state, the heater chip 77 presses the wire 73 toward the terminal electrode 76, so that the end portion of the wire 73 is thermocompression-bonded to the terminal electrode 76.

SUMMARY

In the thermocompression bonding step, pressure is applied by the heater chip 77, so that the wire 73 between the heater chip 77 and the terminal electrode 76 is crushed in a direction in which the pressure is applied. In particular, the wire 73 tends to be excessively crushed in a portion where an edge 76*a* of the terminal electrode 76 makes contact with the wire 73. As a result, the edge 76*a* of the terminal electrode 76 may undesirably cut into the wire 73 and ultimately break the wire 73.

Furthermore, if the heater chip 77 is, for example, displaced rightward from the position illustrated in FIG. 12, an edge 77*a* of the heater chip 77 may undesirably cut into the wire 73 and ultimately break the wire 73.

Accordingly, the present disclosure provides a coil component that includes a terminal electrode made of a metal plate and a wire that is thermocompression-bonded to the terminal electrode and has a structure in which the wire is less likely to be broken and a method for manufacturing the coil component.

Preferred embodiments of the present disclosure relate to a coil component including a wire, a core having a winding core around which the wire is wound and a first flange portion and a second flange portion that are respectively provided at a first end and a second end of the winding core that are ends in an axial direction of the winding core and opposite to each other, and a plurality of terminal electrodes to which the wire is connected and each of which is provided on the first flange portion or the second flange portion and is made of a metal plate. Also, the coil component according to the preferred embodiment the present disclosure has the following features.

Each of the terminal electrodes has a projecting portion that sticks out in the axial direction relative to an end portion of the first flange portion or the second flange portion in the axial direction. The projecting portion has a flat surface along which the wire is thermocompression-bonded. The wire has a crushed sectional shape on the flat surface, and a degree of crushing decreases from a side of a front end toward a side of the first flange portion or the second flange portion of the projecting portion.

The preferred embodiments of the present disclosure also relate to a method for manufacturing the coil component having the above structure.

The method according to the preferred embodiments of the present disclosure includes guiding a wire from a side of a winding core onto a flat surface, and pressing the wire on the flat surface with use of a head surface of a heater chip to thermocompression-bond the wire to the flat surface, in which the thermocompression bonding is performed in a state where an interval between the head surface of the heater chip and the flat surface becomes narrower from a side of a flange portion toward a side of a front end of a projecting portion.

According to the coil component according to the preferred embodiments of the present disclosure, the wire is thermocompression-bonded onto the flat surface of the projecting portion of the terminal electrode. The wire is deformed so that a degree of crushing thereof decreases from the side of the front end toward the side of the flange portion of the projecting portion. Accordingly, on the side of the flange portion of the projecting portion, the wire has a small degree of crushing or is not crushed. This makes it possible to prevent force from being concentrated at a specific portion of the wire under application of mechanical stress to the wire. It is therefore possible to make it less likely for the wire to be broken.

According to the method according to the preferred embodiments of the present disclosure, the thermocompression bonding step is performed in a state where an interval between the head surface of the heater chip and the flat surface of the projecting portion of the terminal electrode becomes narrower from the side of the flange portion toward the side of the front end of the projecting portion. Accordingly, the wire has a small degree of crushing or is not crushed on the side of the flange portion of the projecting portion. It is therefore possible to make it less likely for the wire to be broken in this step.

Other features, elements, characteristics and advantages of the present disclosure will become more apparent from the following detailed description of preferred embodiments of the present disclosure with reference to the attached drawings.

DETAILED DESCRIPTION

First Embodiment

Figure 1:
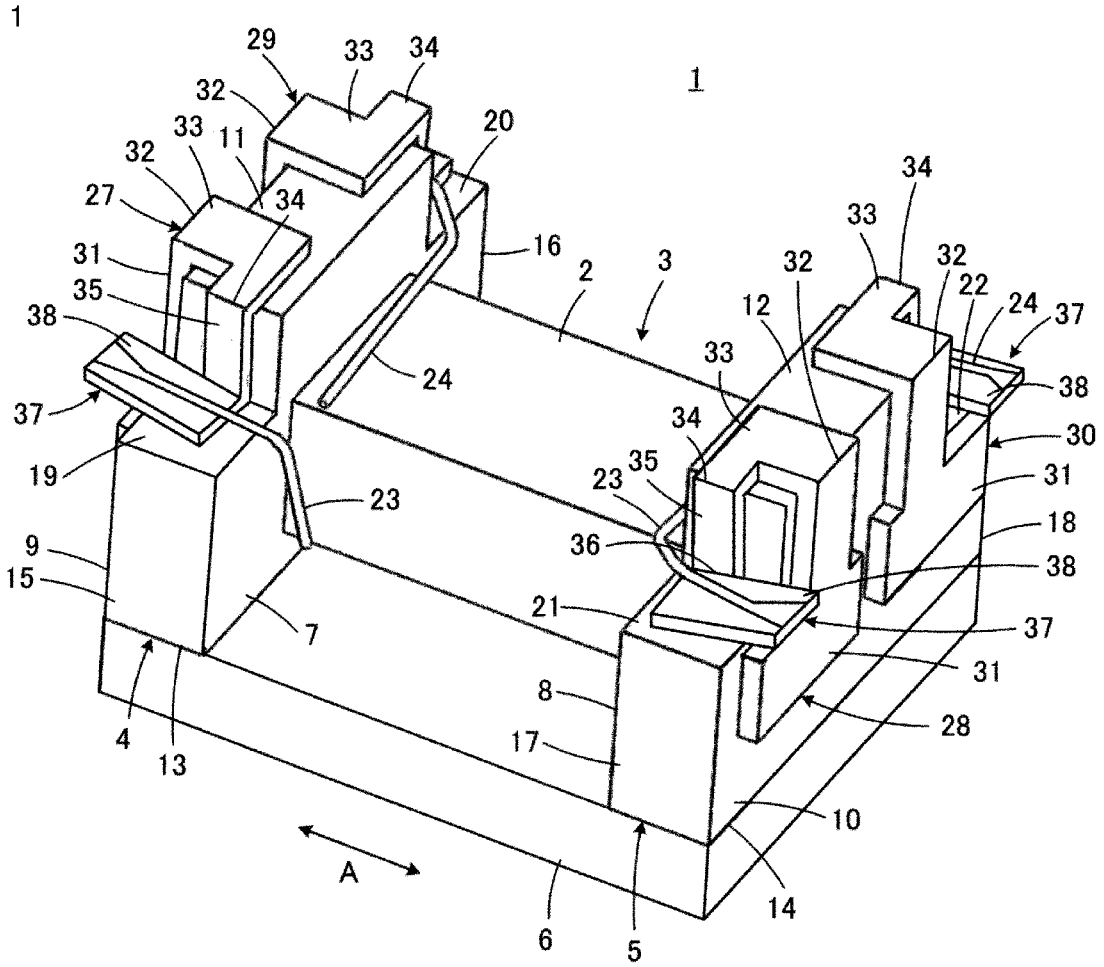
FIG. 1 is a perspective view for explaining a first embodiment of the present disclosure and schematically illustrates outer appearance of a coil component viewed from a side of a mount surface.

A coil component 1 according to a first embodiment of the present disclosure is described with reference to mainly FIG. 1. The coil component 1 illustrated in FIG. 1 constitutes, for example, a common mode choke coil.

The coil component 1 includes a drum-shaped core 3 having a winding core 2. The drum-shaped core 3 has a first flange portion 4 and a second flange portion 5 that are respectively provided at a first end portion and a second end portion of the winding core 2 that are ends in an axial direction A and opposite to each other. The coil component 1 may include a plate-shaped core 6 that is suspended across the first flange portion 4 and the second flange portion 5. The drum-shaped core 3 and the plate-shaped core 6 are made of a non-conducting material, more specifically, a material such as a non-magnetic material (e.g., alumina), a magnetic material (e.g., a Ni—Zn ferrite), or a resin. In a case where the drum-shaped core 3 and the plate-shaped core 6 are made of a resin, the drum-shaped core 3 and the plate-shaped core 6 are made of a resin containing magnetic powder such as metal powder or ferrite powder, a resin containing non-magnetic powder such as silica powder, or a resin containing no filler such as powder.

The first flange portion 4 and the second flange portion 5 have an inner end surface 7 and an inner end surface 8 that face the winding core 2 and on which the respective end portions of the winding core 2 are disposed and an outer end surface 9 and an outer end surface 10 that face a side opposite to the side which the inner end surface 7 and the inner end surface 8 face, respectively. Furthermore, the first flange portion 4 and the second flange portion 5 have a mount surface 11 and a mount surface 12 that face a mount substrate (not illustrated) when the coil component 1 is mounted on the mount substrate and a top surface 13 and a top surface 14 opposite to the mount surface 11 and the mount surface 12, respectively. The plate-shaped core 6 is joined to the top surface 13 of the first flange portion 4 and the top surface 14 of the second flange portion 5. Furthermore, the first flange portion 4 has a first side surface 15 and a second side surface 16 that extend so as to connect the mount surface 11 and the top surface 13 and face away from each other, and the second flange portion 5 has a first side surface 17 and a second side surface 18 that extend so as to connect the mount surface 12 and the top surface 14 and face away from each other.

Furthermore, the first flange portion 4 has cutout-shaped recesses 19 and 20 at respective end portions of the mount surface 11. Similarly, the second flange portion 5 has cutout-shaped recesses 21 and 22 at respective end portions of the mount surface 12.

The coil component 1 further includes a first wire 23 and a second wire 24 that are spirally wound around the winding core 2 in the same direction in parallel with each other. In FIG. 1, only end portions of the first wire 23 and the second wire 24 are illustrated, and illustration of the first wire 23 and the second wire 24 on the winding core 2 is omitted. Also in the other drawings, illustration of the first wire 23 and the second wire 24 on the winding core 2 is omitted.

Each of the first wire 23 and the second wire 24 has a linear central conductor and an insulating coating layer that covers a peripheral surface of the central conductor although specific illustration thereof is omitted. The central conductor is, for example, a copper wire. The insulating coating layer is preferably made of a resin containing at least an imide bond such as polyamide-imide or imide modified polyurethane.

Furthermore, the coil component 1 includes first through fourth terminal electrodes 27 through 30. Among the first through fourth terminal electrodes 27 through 30, the first and third terminal electrodes 27 and 29 are aligned in a direction in which the first and second side surfaces 15 and 16 of the first flange portion 4 face each other and are attached to the first flange portion 4 by using an adhesive. The second and fourth terminal electrodes 28 and 30 are aligned in a direction in which the first and second side surfaces 17 and 18 of the second flange portion 5 face each other and are attached to the second flange portion 5 by using an adhesive.

A first end of the first wire 23 is electrically connected to the first terminal electrode 27, and a second end of the first wire 23 opposite to the first end is electrically connected to the second terminal electrode 28. Meanwhile, a first end of the second wire 24 is electrically connected to the third terminal electrode 29, and a second end of the second wire 24 opposite to the first end is electrically connected to the fourth terminal electrode 30.

The first terminal electrode 27 and the fourth terminal electrode 30 have the same shape, and the second terminal electrode 28 and the third terminal electrode 29 have the same shape. The first terminal electrode 27 and the third terminal electrode 29 are substantially symmetrical about a plane, and the second terminal electrode 28 and the fourth terminal electrode 30 are substantially symmetrical about a plane. In view of this, any one of the first through fourth terminal electrodes 27 through 30, for example, the first terminal electrode 27 is described in detail below, and detailed description of the second, third, and fourth terminal electrodes 28, 29, and 30 is omitted.

Figure 2:
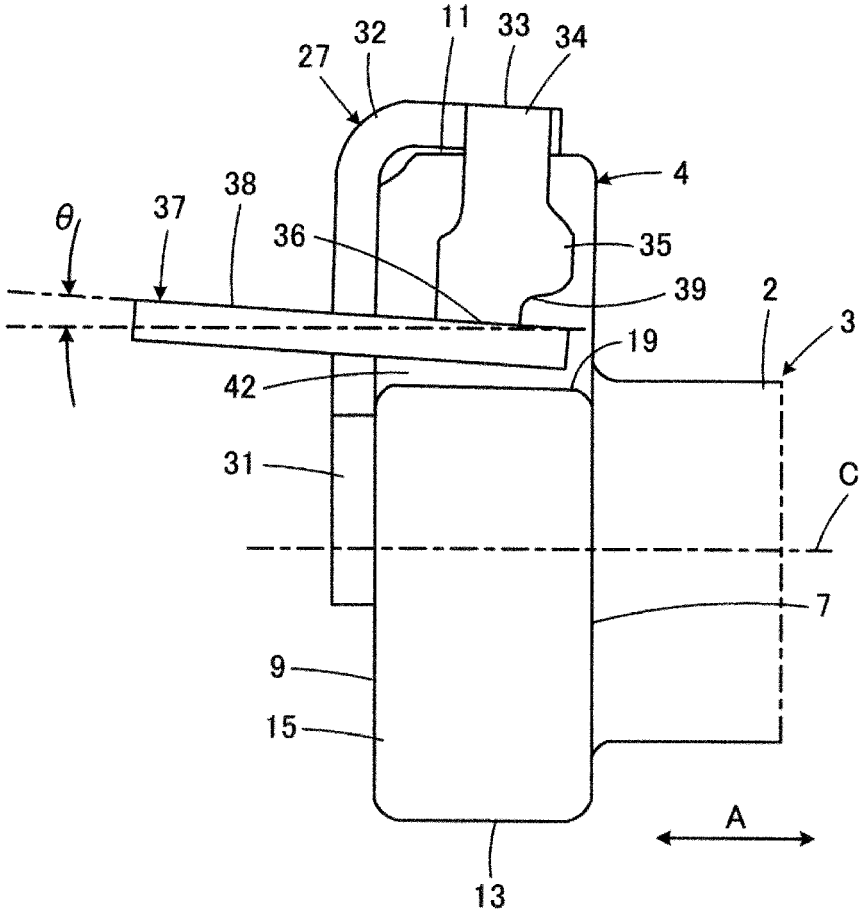
FIG. 2 is an enlarged front view of a part of the coil component illustrated in FIG. 1, specifically, a configuration of a side of a first flange portion of a drum-shaped core and illustrates a state before a wire is thermocompression-bonded to a terminal electrode.
Figure 3:
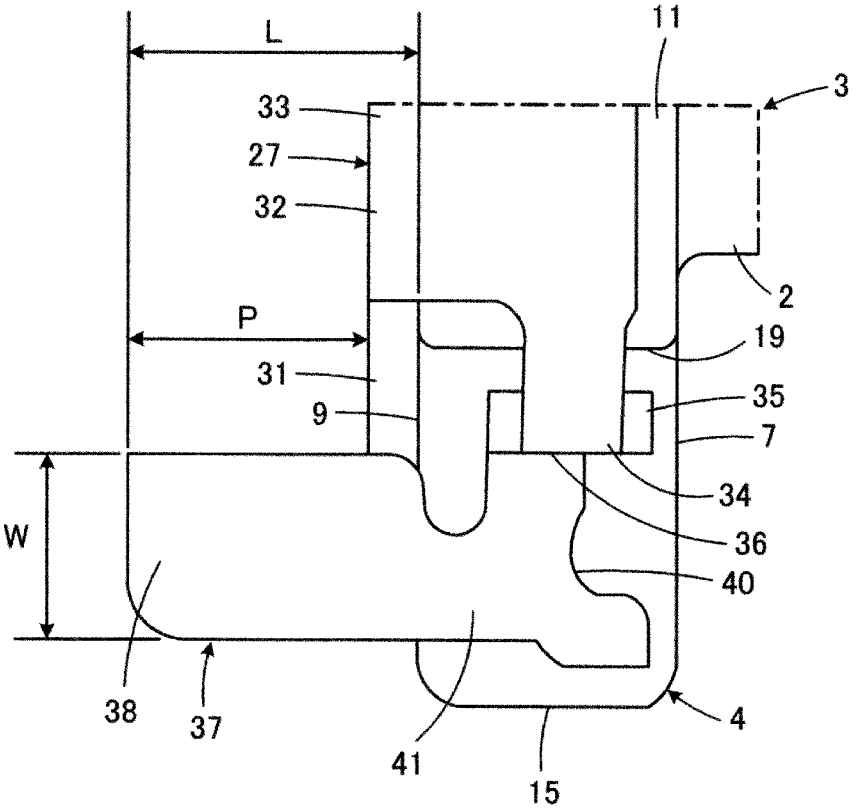
FIG. 3 is a further enlarged plan view of a part of the coil component illustrated in FIG. 1, specifically, a configuration of the side of the first flange portion of the drum-shaped core and illustrates a state before the wire is thermocompression-bonded to the terminal electrode.
Figure 4:
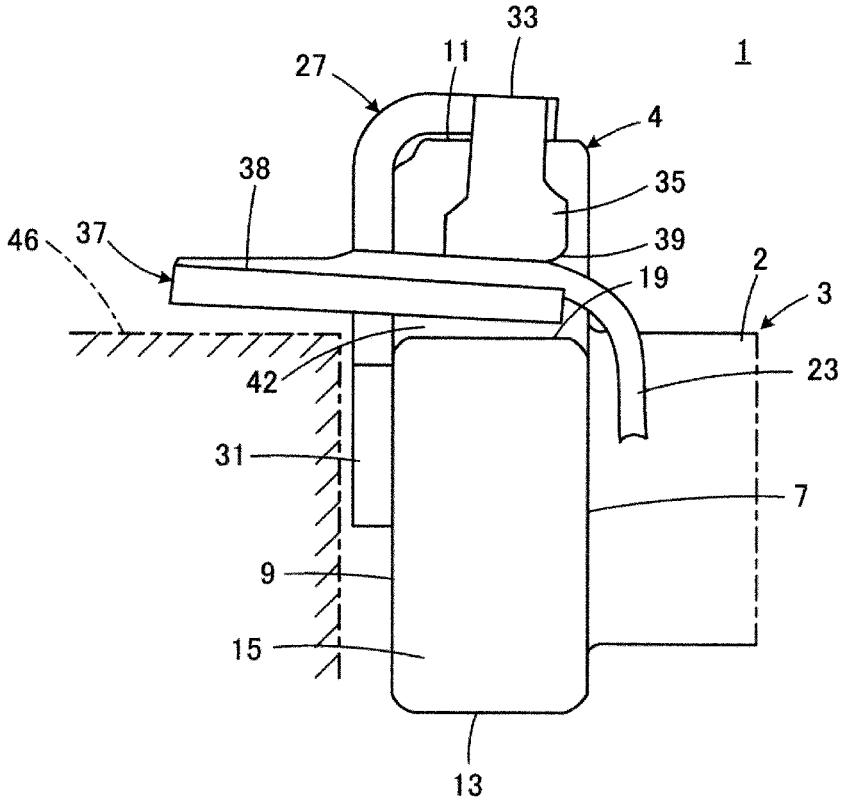
FIG. 4 is a view that corresponds to FIG. 2 and illustrates a state after the wire is thermocompression-bonded to the terminal electrode.
Figure 5:
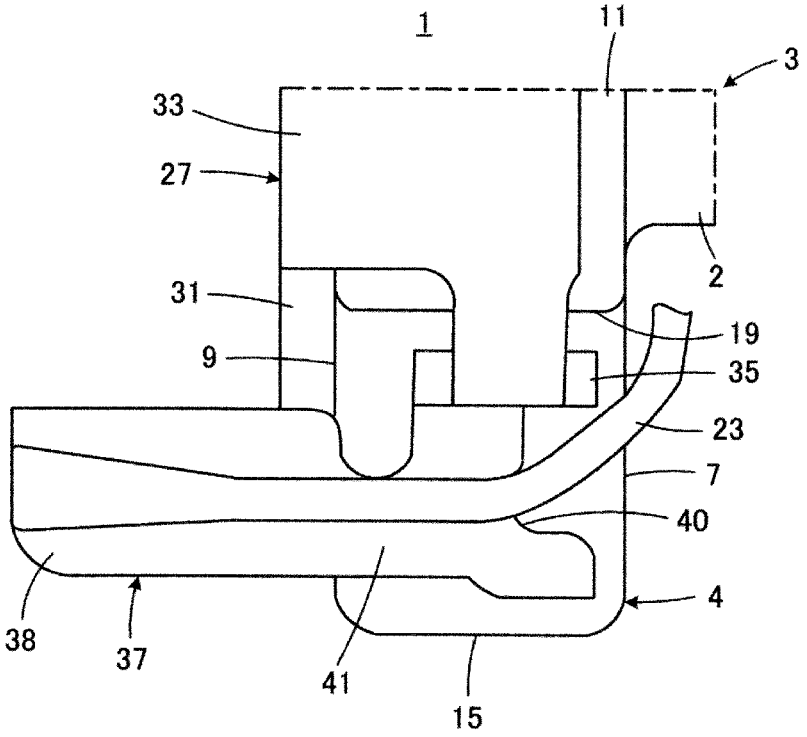
FIG. 5 is a view that corresponds to FIG. 3 and illustrates a state after the wire is thermocompression-bonded to the terminal electrode.

Details of the first terminal electrode 27 are illustrated in FIGS. 2 and 3, and details of a state where the first wire 23 is connected to the first terminal electrode 27 are illustrated in FIGS. 4 and 5. Hereinafter, the "first terminal electrode 27" is simply referred to as a "terminal electrode 27" when the first terminal electrode 27 need not be distinguished from the other terminal electrodes 28 through 30, and the "first wire 23" is simply referred to as a "wire 23" when the first wire 23 need not be distinguished from the second wire 24.

The terminal electrode 27 is typically produced by performing progressive pressing on a single metal plate made of a copper alloy such as phosphor bronze or tough pitch copper. The metal plate of which the terminal electrode 27 is made has a thickness of about 0.15 mm or less, for example, about 0.1 mm.

The terminal electrode 27 includes a base portion 31 that extends along the outer end surface 9 of the first flange portion 4, a first bent portion 32 that covers a ridge line connecting the outer end surface 9 and the mount surface 11 of the first flange portion 4, and a mount portion 33 that extends along the mount surface 11 of the first flange portion 4. The mount portion 33 is a portion that is electrically and mechanically connected to a conductive land on the mount substrate (not illustrated), for example, by soldering when the coil component 1 is mounted on the mount substrate.

Furthermore, the terminal electrode 27 includes a second bent portion 34, a rising portion 35 that extends from the mount portion 33 with the second bent portion 34 interposed therebetween, a third bent portion 36, and a projecting portion 37 that extends from the rising portion 35 with the third bent portion 36 interposed therebetween. The rising portion 35 is located in the cutout-shaped recess 19 of the first flange portion 4.

The projecting portion 37 sticks out in the axial direction A relative to an end of the first flange portion 4 in the axial direction A. The projecting portion 37 is made of a metal plate as described above and sticks out relative to the first flange portion 4. Since the projecting portion 37 is not located on the first flange portion 4, the projecting portion 37 can be elastically displaced due to elasticity of the metal plate. This allows the projecting portion 37 to absorb force applied to the wire 23, for example, in a case where the wire 23 is connected to the terminal electrode 27, thereby making it less likely for the wire 23 to be broken.

The projecting portion 37 is located between the mount portion 33 and the winding core 2 when viewed in the axial direction A. This can make it hard for solder or the like applied to the mount substrate to reach the projecting portion 37 in a state where the coil component 1 is mounted on the mount substrate. If the projecting portion 37 is undesirably fixed by solder or the like after the coil component 1 is mounted, movement of the projecting portion 37 is hindered, and force applied to the projecting portion 37 cannot escape. With the above configuration, such a situation can be made less likely to occur.

For example, a dimension L of the projecting portion 37 in a longitudinal direction is about 0.57 mm, a dimension W of the projecting portion 37 in a width direction is about 0.30 mm, and a protruding length P of the projecting portion 37 from an outer side surface of the base portion 31 is about 0.47 mm (see FIG. 3).

As illustrated in FIGS. 4 and 5, the projecting portion 37 is a part that electrically and mechanically connects the wire 23 to the terminal electrode 27 and has a flat surface 38 along which the wire 23 is thermocompression-bonded. Note that the flat surface 38 need not be entirely flat. For example, the flat surface 38 may have a bulging part or a recessed part or may have a warped edge or a rounded edge.

As illustrated in FIG. 2, the flat surface 38 is located relatively away from the mount portion 33, the flat surface 38 of the projecting portion 37 faces the mount portion 33, and is located closer to the mount portion 33 than a central axis line C of the winding core 2. The flat surface 38 is inclined farther away from the central axis line C of the winding core 2 as a distance from the first flange portion 4 becomes larger. The inclination angle θ is, for example, larger than approximately 0° and is smaller than approximately 10° (i.e., from approximately 0° to approximately 10°).

The terminal electrode 27 has some characteristic forms in details thereof (not illustrated in FIG. 1) as described below.

First, as illustrated in FIG. 2, the rising portion 35 has a recessed portion 39 on an edge thereof on a side of the winding core 2. The recessed portion 39 is provided close to the third bent portion 36 that serves as a boundary between the rising portion 35 and a part extending from the projecting portion 37. Furthermore, as illustrated in FIG. 3, the part extending from the projecting portion 37 has a recessed portion 40 on an edge thereof on the side of the winding core 2. These recessed portions 39 and 40 function to accommodate the wire 23 guided from the side of the winding core 2 onto the flat surface 38 of the terminal electrode 27 and temporarily fix a position of the wire 23.

For example, a wire (e.g., the wire 23 guided to the first terminal electrode 27) extended from a lower surface of the winding core 2 in FIG. 1 is accommodated in the recessed portion 40 of the part extending from the projecting portion 37. FIG. 5 illustrates a state where the wire 23 is accommodated in the recessed portion 40. Meanwhile, a wire (e.g., the second wire 24 guided to the third terminal electrode 29) extended from a side surface of the winding core 2 on a near side in FIG. 1 is accommodated in the recessed portion 39 of the rising portion 35. Edges that define the recessed portions 39 and 40 are preferably rounded so that a wire is less likely to be broken when the recessed portions 39 and 40 play the above function.

Furthermore, as illustrated in FIG. 3, a constricted portion 41 whose width is relatively narrow is provided at a boundary between the projecting portion 37 and the part extending from the projecting portion 37 toward the side of the winding core 2. The constricted portion 41 functions to restrict heat transfer. More specifically, the constricted portion 41 is provided so that heat from a heater chip is efficiently applied to a front end portion of the projecting portion 37 in a thermocompression bonding step, which will be described later, in other words, so that escape, toward a side of the mount portion 33, of heat from the heater chip is kept as small as possible.

Furthermore, as illustrated in FIGS. 2 and 4, the projecting portion 37 is separated away from the first flange portion 4. That is, the projecting portion 37 does not make contact with the first flange portion 4 on a side opposite to the flat surface 38, so that a gap 42 is created between the projecting portion 37 and the first flange portion 4. Accordingly, the projecting portion 37 can be elastically displaced so as to close the gap 42.

References signs 31, 32, 33, 34, 35, 36, 37, and 38, which are used to denote the base portion, the first bent portion, the mount portion, the second bent portion, the rising portion, the third bent portion, the projecting portion, and the flat surface of the first terminal electrode 27, respectively, are also used to denote corresponding parts of each of the second, third, and fourth terminal electrodes 28, 29, and 30 as needed in the descriptions below and drawings.

Next, a method for manufacturing the coil component 1, especially a step for thermocompression-bonding the first wire 23 and the second wire 24 to the terminal electrodes 27 through 30 is described.

Typically, a step for winding the first wire 23 and the second wire 24 around the winding core 2 is performed before the step for thermocompression-bonding the first wire 23 and the second wire 24 to the first through fourth terminal electrodes 27 through 30. In this winding step, the first wire 23 and the second wire 24 are fed from a nozzle toward the winding core 2 while traversing the first wire 23 and the second wire 24 in a state where the drum-shaped core 3 is being rotated about the central axis line C of the winding core 2. As a result, the first wire 23 and the second wire 24 are spirally wound around the winding core 2.

The drum-shaped core 3 is held by a chuck connected to a rotary drive source since the drum-shaped core 3 is rotated in this winding step as described above. The chuck is designed to hold one of the flange portions of the drum-shaped core 3, for example, the first flange portion 4.

After the winding step, the step for thermocompression-bonding the first wire 23 and the second wire 24 to the first through fourth terminal electrodes 27 through 30 is performed. The following describes, as a representative example, a step for thermocompression-bonding the first wire 23 to the first terminal electrode 27. Also in the following description, the "first terminal electrode 27" is simply referred to as a "terminal electrode 27" when the first terminal electrode 27 need not be distinguished from the other terminal electrodes 28 through 30, and the "first wire 23" is simply referred to as a "wire 23" when the first wire 23 need not be distinguished from the second wire 24. Furthermore, the "first flange portion 4" is simply referred to as a "flange portion 4" when the first flange portion 4 need not be distinguished from the second flange portion 5.

Figure 6:
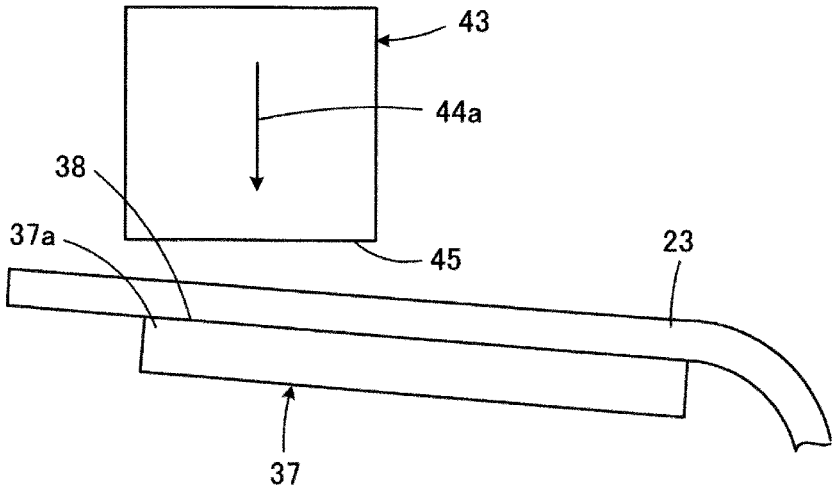
FIG. 6 is a schematic explanatory view for explaining steps for thermocompression-bonding the wire to a projecting portion of the terminal electrode in the coil component illustrated in FIGS. 1 through 5.
Figure 6:
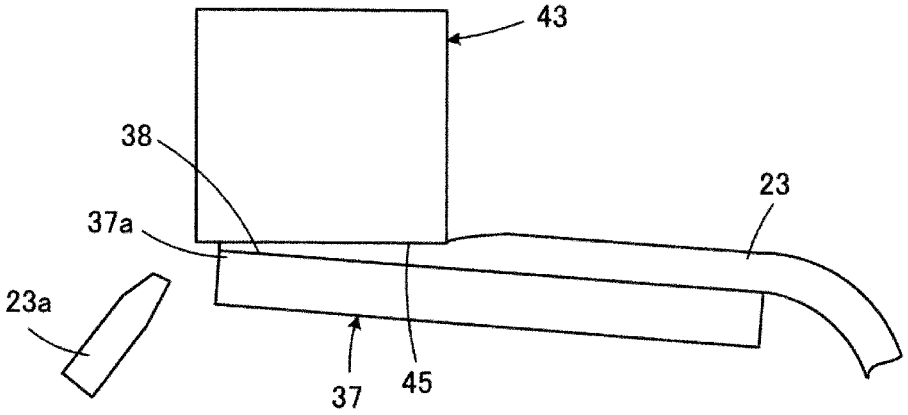
Figure 6:
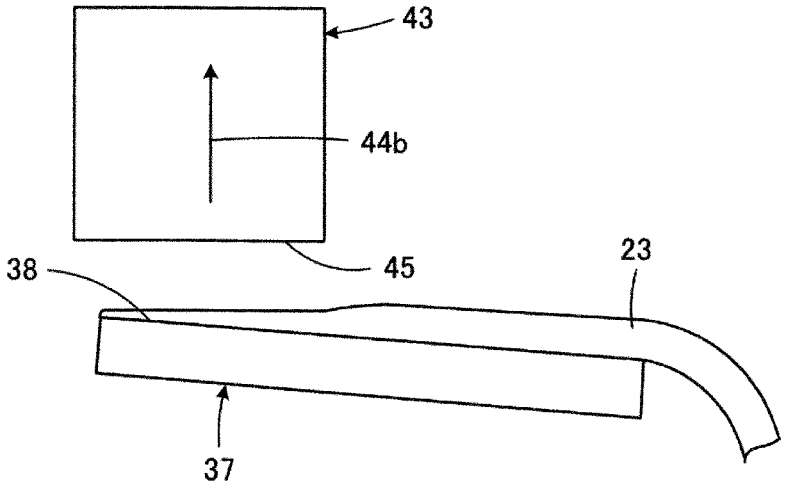

After completion of the winding step, the wire 23 is guided onto the flat surface 38 of the projecting portion 37 as illustrated in step (1) of FIG. 6. In this stage, an insulating coating layer may have been removed from an end portion of the wire 23 or may remain on the end portion of the wire 23. To remove the insulating coating layer, laser light irradiation is applied for example. In a case where the insulating coating layer is present, the insulating coating layer is removed at the same time as the thermocompression bonding by heat generated in the thermocompression bonding step described later.

In step (1) of FIG. 6, a heater chip 43 is illustrated above the projecting portion 37. The heater chip 43 performs pressing operation in a direction indicated by arrow 44*a* and then returns in a direction indicated by arrow 44*b* illustrated in step (3) of FIG. 6. A head surface 45 of the heater chip 43 extends in a direction orthogonal to a pressing direction indicated by arrow 44*a* of the heater chip 43. Meanwhile, the flat surface 38 of the projecting portion 37 is inclined by inclination angle θ illustrated in FIG. 2 and therefore extends in a direction that is not orthogonal to the pressing direction indicated by arrow 44*a* of the heater chip 43.

Next, the heater chip 43 performs pressing operation in the direction indicated by arrow 44*a* and presses the wire 23 on the flat surface 38 with use of the head surface 45 of the heater chip 43 as illustrated in step (2) of FIG. 6. This causes the wire 23 to be thermocompression-bonded to the flat surface 38. In this thermocompression bonding step, the flat surface 38 extends in the direction that is not orthogonal to the pressing direction indicated by arrow 44*a* of the heater chip 43, and the head surface 45 of the heater chip 43 extends in the direction orthogonal to the pressing direction indicated by arrow 44*a* of the heater chip 43, as described above. Accordingly, the thermocompression bonding step is performed in a state where an interval between the head surface 45 of the heater chip 43 and the flat surface 38 becomes narrower from a side of the flange portion 4 toward a side of the front end portion of the projecting portion 37.

As a result, the wire 23 is deformed to have a crushed sectional shape on the flat surface 38, and a degree of crushing decreases from the side of the front end portion toward the side of the flange portion 4 of the projecting portion 37. That is, a dimension of the wire 23 becomes larger from the side of the front end portion toward the side of the flange portion 4 of the projecting portion 37 when the wire 23 is viewed in a direction illustrated in FIG. 4. Meanwhile, the dimension of the wire 23 becomes larger from the side of the flange portion 4 toward the side of the front end portion of the projecting portion 37 when the wire 23 is viewed in a direction illustrated in FIG. 5. The dimensional increase of the wire 23 viewed in the direction illustrated in FIG. 5 falls within the dimension W (see FIG. 3) of the projecting portion 37 in the width direction.

For example, in a case where an original diameter of the wire 23 is about 0.03 mm, the wire 23 is crushed until a radial dimension of the wire 23 viewed in the direction illustrated in FIG. 5 is expanded to about 0.05 mm to about 0.06 mm and a radial dimension of the wire 23 viewed in the direction illustrated in FIG. 4 decreases to about 0.005 mm to about 0.010 mm.

As is clear from the above description, the "degree of crushing" as used herein refers to a degree of increase of a radial dimension of a wire viewed from a direction orthogonal to a flat surface from a state before thermocompression bonding to a state after the thermocompression bonding or a degree of decrease of a radial dimension of a wire viewed from a direction parallel with a flat surface from a state before thermocompression bonding to a state after the thermocompression bonding.

As described above, the projecting portion 37 sticks out in the axial direction A relative to the end portion of the first flange portion 4 in the axial direction A and can be elastically displaced. Furthermore, the projecting portion 37 forms the gap 42 with the flange portion 4 and can be elastically displaced so as to close the gap 42. Such displacement of the projecting portion 37 is caused, for example, by pressing force applied by the heater chip 43 in the thermocompression bonding step. This makes it easy to control the pressing force applied by the heater chip 43. This is because the elastic displacement of the projecting portion 37 acts to absorb a fluctuation in the pressing force applied by the heater chip 43.

The elastic displacement of the projecting portion 37 caused by the pressing force applied by the heater chip 43 occurs so that the inclination angle θ (see FIG. 2) of the flat surface 38 becomes smaller. In this state, tensional force for stretching the wire 23 is applied to the wire 23. However, after the thermocompression bonding, the pressing force is no longer applied by the heater chip 43, and therefore the flat surface 38 tries to return to the original inclined state. This returning operation of the flat surface 38 loosens the tensional force applied to the wire 23. This also makes it less likely for the wire 23 to be broken.

A support table 46 that supports the projecting portion 37 from a side opposite to a side of the flat surface 38 may be incorporated in a thermocompression bonding apparatus as indicated by the imaginary line (the line with alternate long and short dashes and the diagonal lines) in FIG. 4. The support table 46 supports the projecting portion 37 from the side opposite to the side of the flat surface 38 in the thermocompression bonding step. This prevents, for example, the flange portion 4 from being broken by the pressing force applied by the heater chip 43. Furthermore, the support table 46 acts to prevent the elastic displacement of the projecting portion 37 from exceeding a limit.

As illustrated in step (2) of FIG. 6, not only the wire 23 is thermocompression-bonded to the flat surface 38, but also an excess part of the wire 23 that sticks out from the projecting portion 37 is removed by cutting. More specifically, the wire 23 is cut by pressing the head surface 45 of the heater chip 43 against the wire 23 toward a sharp edge 37*a* of the projecting portion 37. As a result, a cut piece 23*a* of the wire 23 is removed from the wire 23 thermocompression-bonded to the flat surface 38.

Next, as illustrated in step (3) of FIG. 6, the heater chip 43 moves up in the direction indicated by arrow 44*b*. Then, the step for thermocompression-bonding the wire 23 ends. It is preferable that a part of the wire 23 along the projecting portion 37 still has a part that is not crushed, in other words, a part having an original sectional shape on the side of the flange portion 4 after the thermocompression bonding step. This is because the wire 23 is less likely to be broken in this case.

As described above, a step for thermocompression-bonding the first wire 23 to the first terminal electrode 27 is performed. Similarly, a step for thermocompression-bonding the first wire 23 to the second terminal electrode 28, a step for thermocompression-bonding the second wire 24 to the third terminal electrode 29, and a step for thermocompression-bonding the second wire 24 to the fourth terminal electrode 30 are performed. After these thermocompression-bonding steps, the coil component 1 is completed as a product. That is, only thermocompression bonding is used to connect the first wire 23 and the second wire 24 to the first through fourth terminal electrodes 27 through 30.

However, a welding step using laser light irradiation or the like may be further performed as needed instead of using only thermocompression bonding to connect the first wire 23 and the second wire 24 to the first through fourth terminal electrodes 27 through 30.

Second Embodiment

Figure 7:
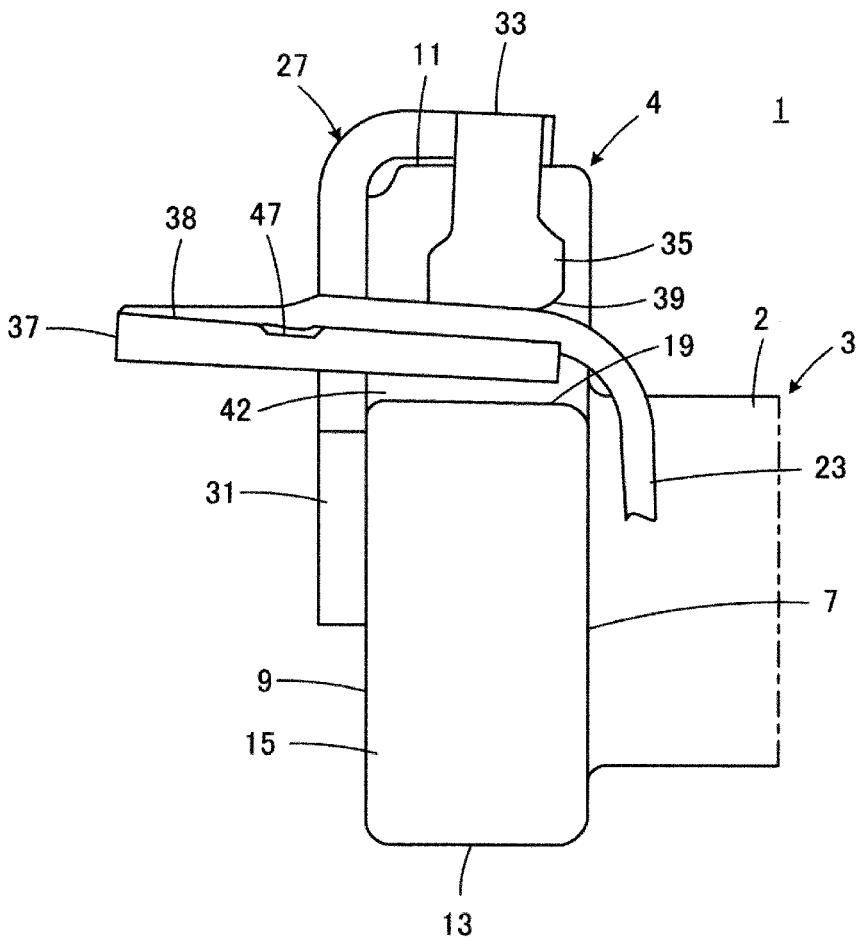
FIG. 7 is a view that corresponds to FIG. 4, for explaining a second embodiment of the present embodiment and illustrates a part of a coil component.
Figure 8:
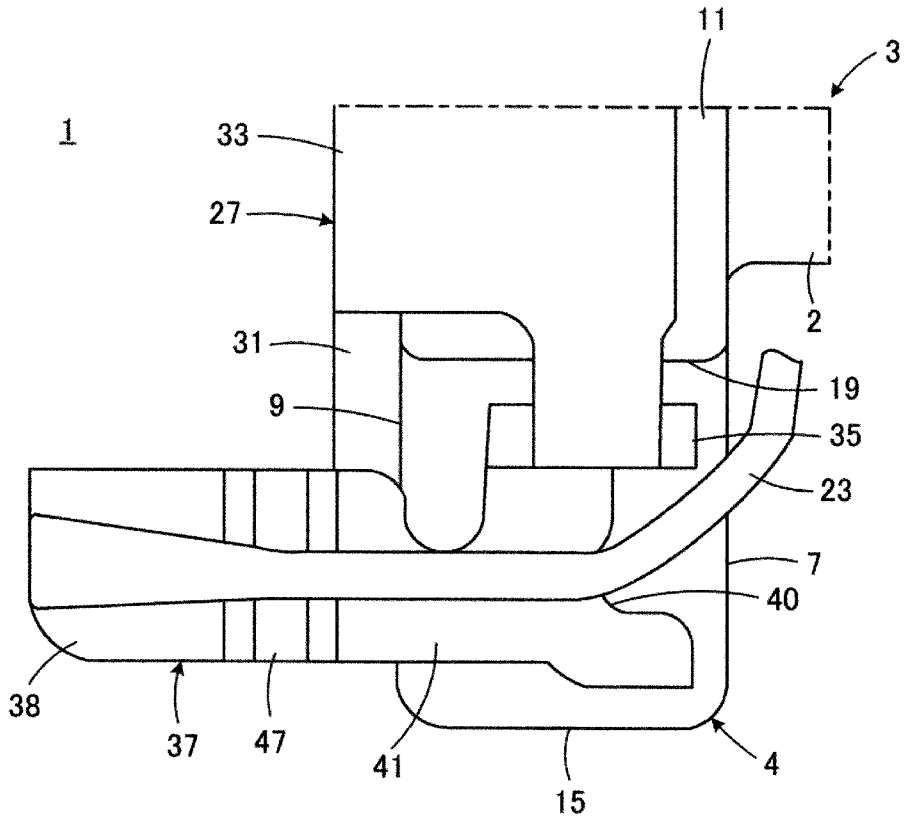
FIG. 8 is a view that corresponds to FIG. 5 and illustrates a part of the coil component illustrated in FIG. 7.
Figure 9:
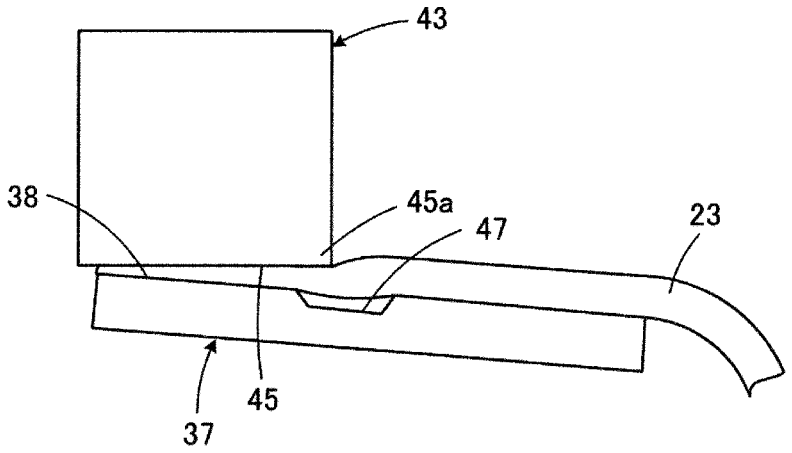
FIG. 9 is a schematic explanatory view for explaining a step for thermocompression-bonding a wire to a terminal electrode in the coil component illustrated in FIGS. 7 and 8.

A second embodiment of the present disclosure is described below with reference to FIGS. 7 through 9. FIG. 7 corresponds to FIG. 4, FIG. 8 corresponds to FIG. 5, and FIG. 9 corresponds to step (2) of FIG. 6. In FIGS. 7 through 9, elements corresponding to the elements illustrated in FIGS. 4 through 6 are given similar reference signs, and repeated description thereof is omitted.

In FIGS. 7 through 9, a first terminal electrode 27, a first wire 23, and a first flange portion 4 are illustrated as in FIGS. 4 through 6. Accordingly, hereinafter, the "first terminal electrode 27" is simply referred to as a "terminal electrode 27", the "first wire 23" is simply referred to as a "wire 23", and the "first flange portion 4" is simply referred to as a "flange portion 4".

In the second embodiment, a projecting portion 37 has a lower-level surface 47 that is located at a lower level than a flat surface 38. The lower-level surface 47 is provided so as to traverse in a width direction of the projecting portion 37. At least a part of the flat surface 38 is present on a side of a front end portion of the projecting portion 37 relative to the lower-level surface 47. It is preferable that a boundary part between the lower-level surface 47 and the flat surface 38, which absorbs a difference in height between the lower-level surface 47 and the flat surface 38, have a gradient surface as illustrated in FIG. 7. Note that the lower-level surface 47 need not completely traverse the projecting portion 37 in the width direction and may be provided so as to traverse only a part of the projecting portion 37 in the width direction.

In the present embodiment, in a thermocompression bonding step illustrated in FIG. 9, a heater chip 43 which is positioned to face the flat surface 38 with a wire 23 interposed therebetween presses the wire 23 against the flat surface 38. In this step, an edge 45*a* of a head surface 45 of the heater chip 43 on a side of the flange portion 4 is positioned to face the lower-level surface 47.

With this positional relationship between the head surface 45 of the heater chip 43 and the lower-level surface 47, a part of the wire 23 that makes contact with the edge 45*a* of the head surface 45 is slightly deformed toward the lower-level surface 47 as illustrated in FIG. 9. This allows pressing force applied by the edge 45*a* of the head surface 45 to escape. As a result, it is less likely that the edge 45*a* of the head surface 45 cuts into the wire 23 and thereby breaks the wire 23.

Third Embodiment

Figure 10:
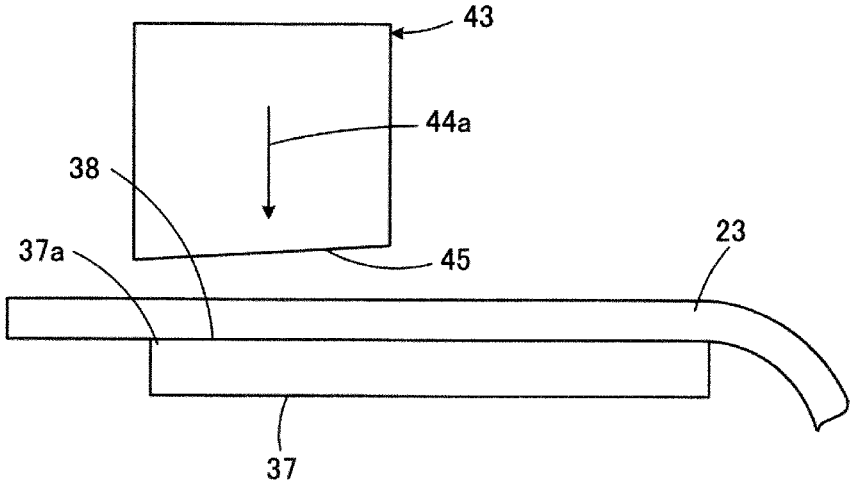
FIG. 10 is a schematic explanatory view for explaining a third embodiment of the present disclosure and for explaining steps for thermocompression-bonding a wire to a projecting portion of a terminal electrode.
Figure 10:
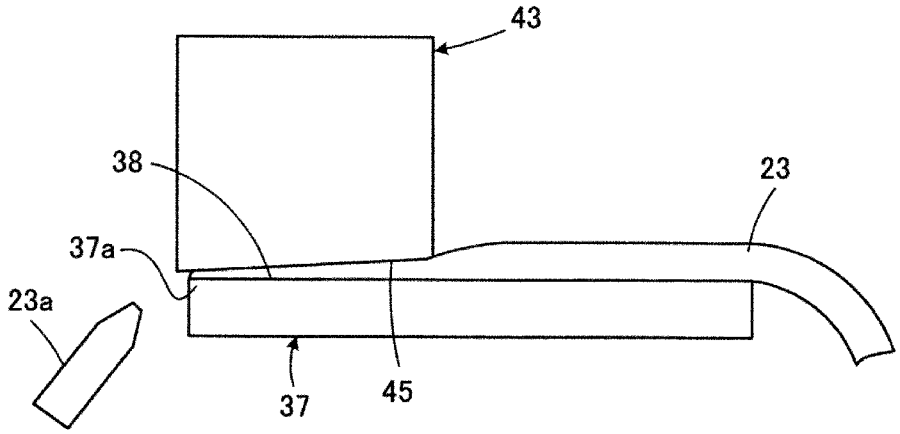
Figure 10:
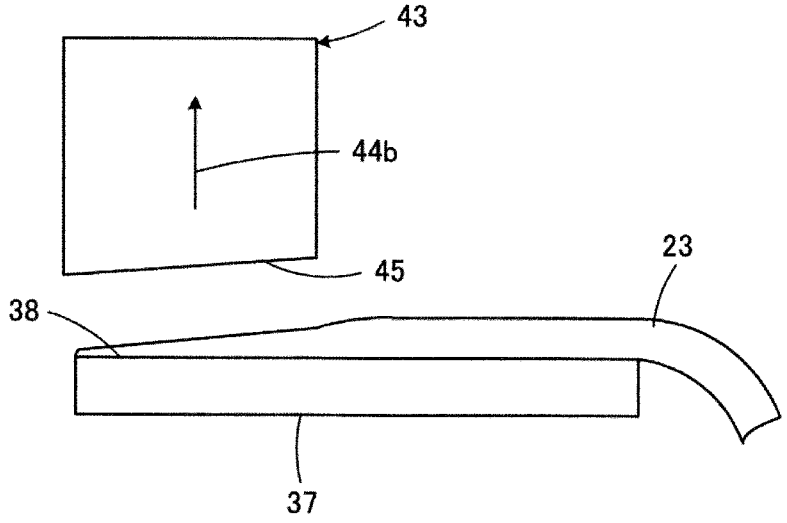

A third embodiment of the present disclosure is described below with reference to FIG. 10. FIG. 10 corresponds to FIG. 6. In FIG. 10, elements corresponding to the elements illustrated in FIG. 6 are given similar reference signs, and repeated description thereof is omitted.

The present embodiment also discusses a first terminal electrode 27 and a first wire 23, and the "first terminal electrode 27" is simply referred to as a "terminal electrode 27", and the "first wire 23" is simply referred to as a "wire 23".

In the present embodiment, a thermocompression bonding step is performed in a state where an interval between a head surface 45 of a heater chip 43 and a flat surface 38 becomes narrower from a side of a flange portion 4 toward a side of a front end portion of a projecting portion 37 as in the first and second embodiments.

In the present embodiment, the flat surface 38 of the projecting portion 37 extends in a direction orthogonal to a pressing direction indicated by arrow 44*a* of the heater chip 43, and the head surface 45 of the heater chip 43 extends in a direction that is not orthogonal to the pressing direction indicated by arrow 44*a* of the heater chip 43. Accordingly, in the present embodiment, the flat surface 38 need not be given an inclination angle such as the inclination angle θ illustrated in FIG. 2.

Processing performed on the wire 23 in the thermocompression bonding steps illustrated in FIG. 10 is substantially similar to that in the thermocompression bonding steps illustrated in FIG. 6. Specifically, the heater chip 43 moves down in a direction indicated by arrow 44*a* from a state illustrated in step (1) of FIG. 10. Then, as illustrated in step (2) of FIG. 10, the wire 23 on the flat surface 38 is pressed by the head surface 45 of the heater chip 43, so that the wire 23 is thermocompression-bonded to the flat surface 38. As a result, the wire 23 is deformed to have a crushed sectional shape on the flat surface 38, and a degree of crushing becomes smaller from the side of the front end portion toward the side of the flange portion 4 of the projecting portion 37.

As illustrated in step (2) of FIG. 10, the head surface 45 of the heater chip 43 presses the wire 23 toward a sharp edge 37*a* of the projecting portion 37. As a result, a part of the wire 23 that sticks out from the projecting portion 37 is removed as a cut piece 23*a*. Then, as illustrated in step (3) of FIG. 10, the heater chip 43 moves up in a direction indicated by arrow 44*b*. Then, the step for thermocompression-bonding the wire 23 ends.

According to the present embodiment, processing for giving inclination to the flat surface 38 is not needed on a side of the terminal electrode 27, and the wire 23 can be deformed to have a shape such that a degree of crushing decreases from the side of the front end portion toward the side of the flange portion 4 of the projecting portion 37 only by making a relatively easy change of giving inclination to the head surface 45 of the heater chip 43.

Note that it is also possible to employ an embodiment in which not only the head surface 45 of the heater chip 43 extends in a direction that is not orthogonal to the pressing direction indicated by arrow 44*a* of the heater chip 43 as in the third embodiment, but also the flat surface 38 extends in a direction that is not orthogonal to the pressing direction indicated by arrow 44*a* of the heater chip 43 as in the first embodiment, as long as the condition is satisfied that the thermocompression bonding step is performed in a state where the interval between the head surface 45 of the heater chip 43 and the flat surface 38 becomes narrower from the side of the flange portion 4 toward the side of the front end portion of the projecting portion 37.

Fourth Embodiment

Figure 11:
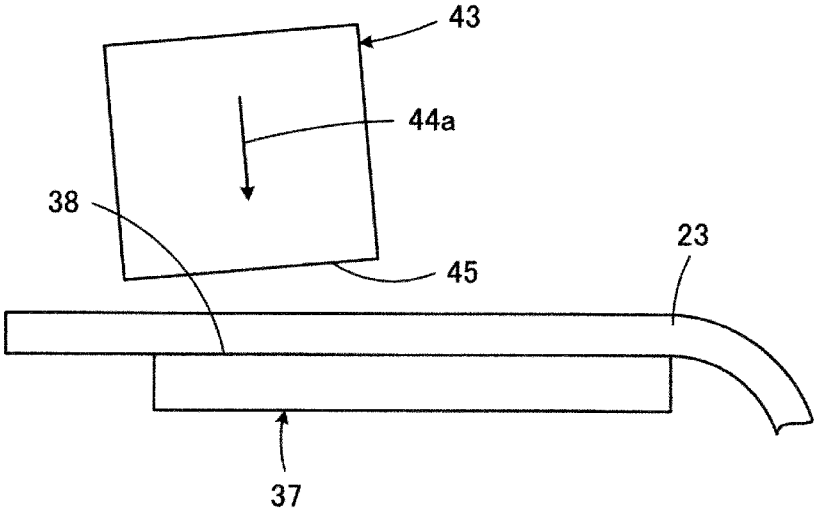
FIG. 11 is a schematic explanatory view for explaining a fourth embodiment of the present disclosure and for explaining a step for thermocompression-bonding a wire to a projecting portion of a terminal electrode.
Figure 12:
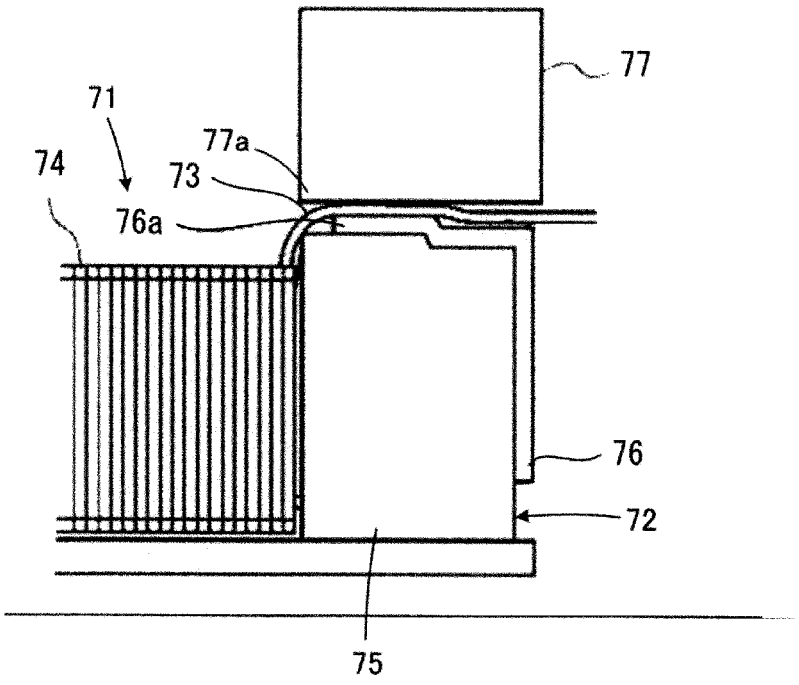
FIG. 12 is a front view illustrating one flange portion that is a part of a drum-shaped core of a coil component described in Japanese Unexamined Patent Application Publication No. 2015-50373 and a terminal electrode provided on the flange portion and is for explaining a step for thermocompression-bonding a wire to the terminal electrode.

A fourth embodiment of the present disclosure is described below with reference to FIG. 11. FIG. 11 corresponds to step (1) of FIG. 6. In FIG. 11, elements corresponding to the elements illustrated in FIG. 6 are given similar reference signs, and repeated description thereof is omitted.

The present embodiment also discusses a first terminal electrode 27 and a first wire 23, and the "first terminal electrode 27" is simply referred to as a "terminal electrode 27", and the "first wire 23" is simply referred to as a "wire 23".

In the present embodiment, the thermocompression bonding step is performed in a state where an interval between a head surface 45 of a heater chip 43 and a flat surface 38 becomes narrower from a side of a flange portion 4 toward a side of a front end portion of a projecting portion 37, as in the first through third embodiments.

In the present embodiment, the flat surface 38 of the projecting portion 37 extends in a direction that is not orthogonal to a pressing direction indicated by arrow 44*a* of the heater chip 43, and the head surface 45 of the heater chip 43 extends in a direction that is orthogonal to the pressing direction indicated by arrow 44*a* of the heater chip 43, as in the first and second embodiments. However, in the present embodiment, the flat surface 38 is not given an inclination angle such as the inclination angle θ illustrated in FIG. 2 as in the third embodiment, unlike the first and second embodiments. Instead, a pressing direction of the heater chip 43 is not a vertical direction but a direction that crosses the vertical direction at a predetermined angle.

Processing performed on the wire 23 in the thermocompression bonding step in the present embodiment is substantially similar to that in the thermocompression bonding step illustrated in FIG. 6, and therefore repeated description thereof is omitted. Also in the present embodiment, the wire 23 on the flat surface 38 is pressed by the head surface 45 of the heater chip 43, and thus the wire 23 is thermocompression-bonded to the flat surface 38. As a result, the wire 23 has a crushed sectional shape on the flat surface 38, and a degree of crushing decreases from the side of the front end portion toward the side of the flange portion 4 of the projecting portion 37.

Although the present disclosure has been described on the basis of the embodiments related to a coil component that constitutes a common mode choke coil, these embodiments are illustrative examples and can be modified in various ways.

For example, the number of wires of the coil component, a direction in which a wire is wound, the number of terminal electrodes, and the like can be varied depending on functions of the coil component.

As for the number of terminal electrodes, in the embodiments illustrated above, the total number of terminal electrodes is four (two terminal electrodes are provided on a first flange portion and two terminal electrodes are provided on a second flange portion) since the coil component constitutes a common mode choke coil. However, this configuration is not restrictive. Alternatively, the total number of terminal electrodes may be two (a single terminal electrode is provided on the first flange portion and a single terminal electrode is provided on the second flange portion). Alternatively, the total number of terminal electrodes may be six or more (three or more terminal electrodes are provided on the first flange portion and three or more terminal electrodes are provided on the second flange portion). Furthermore, the number of terminal electrodes provided on the first flange portion and the number of terminal electrodes disposed on the second flange portion may be different from each other.

The embodiments described herein are illustrative examples, and elements in different embodiments may be exchanged or combined with each other.

While preferred embodiments of the disclosure have been described above, it is to be understood that variations and modifications will be apparent to those skilled in the art without departing from the scope and spirit of the disclosure.

The scope of the disclosure, therefore, is to be determined solely by the following claims.

What is claimed is:

1. A coil component comprising:

a wire;

a core having a winding core around which the wire is wound, and a first flange portion and a second flange portion that are respectively provided at a first end and a second end of the winding core that are ends in an axial direction of the winding core and opposite to each other; and a plurality of terminal electrodes to which the wire is connected, and each of the terminal electrodes is provided on the first flange portion or the second flange portion and is made of a metal plate, wherein each of the terminal electrodes has a projecting portion that sticks out in the axial direction relative to an end portion of the first flange portion or the second flange portion in the axial direction, the projecting portion has a flat surface along which the wire is thermocompression-bonded, the wire has a crushed sectional shape on the flat surface, and a degree of crushing decreases from a side of a front end of the projecting portion toward a side of the first flange portion or the second flange portion of the projecting portion, and a dimension of the crushed sectional shape of the wire increases from the side of the first flange portion or the second flange portion toward the side of the front end of the projecting portion when viewed from a direction orthogonal to a mount surface of the first flange portion or the second flange portion.

2. The coil component according to claim 1, wherein each of the terminal electrodes has a mount portion that extends along a mount surface of the first flange portion or a mount surface of the second flange portion; and the projecting portion is located between the mount portion and the winding core when viewed in the axial direction.

3. The coil component according to claim 2, wherein the flat surface of the projecting portion faces the mount portion, is located closer to the mount portion than a central axis line of the winding core, and is inclined farther away from the central axis line of the winding core as a distance from the first flange portion or the second flange portion becomes larger.

4. The coil component according to claim 1, wherein a part of the wire that is along the projecting portion has a part that is not crushed on the side of the first flange portion or the second flange portion.

5. The coil component according to claim 1, wherein the projecting portion is separated away from the first flange portion or the second flange portion.

6. The coil component according to claim 1, wherein the projecting portion has a lower-level surface that is located at a lower level than the flat surface; and the lower-level surface is provided to traverse at least a part of the projecting portion in a direction perpendicular to the axial direction, and at least a part of the flat surface is present on the side of the front end of the projecting portion relative to the lower-level surface.

7. The coil component according to claim 2, wherein a part of the wire that is along the projecting portion has a part that is not crushed on the side of the first flange portion or the second flange portion.

8. The coil component according to claim 2, wherein the projecting portion is separated away from the first flange portion or the second flange portion.

9. The coil component according to claim 2, wherein the projecting portion has a lower-level surface that is located at a lower level than the flat surface; and the lower-level surface is provided to traverse at least a part of the projecting portion in a direction perpendicular to the axial direction, and at least a part of the flat surface is present on the side of the front end of the projecting portion relative to the lower-level surface.

10. A method for manufacturing a coil component including a wire, a core having a winding core around which the wire is wound and a first flange portion and a second flange portion that are respectively provided at a first end and a second end of the winding core that are ends in an axial direction of the winding core and opposite to each other, and a plurality of terminal electrodes to which the wire is connected and each of which is provided on the first flange portion or the second flange portion and is made of a metal plate, in which each of the terminal electrodes has a projecting portion that sticks out in the axial direction relative to an end of the first flange portion or the second flange portion in the axial direction, and in which the projecting portion has a flat surface along which the wire is thermocompression-bonded, the method comprising:

guiding the wire from a side of the winding core onto the flat surface; and pressing the wire on the flat surface with use of a head surface of a heater chip to thermocompression-bond the wire to the flat surface, such that the wire has a crushed sectional shape and the thermocompression bonding is performed in a state where an interval between the head surface of the heater chip and the flat surface becomes narrower from a side of the first flange portion or the second flange portion toward a side of a front end of the projecting portion, wherein a dimension of the crushed sectional shape of the wire increases from the side of the first flange portion or the second flange portion toward the side of the front end of the projecting portion when viewed from a direction orthogonal to a mount surface of the first flange portion or the second flange portion.

11. The method according to claim 10, wherein the thermocompression bonding includes elastically displacing the projecting portion by pressing of the heater chip.

12. The method according to claim 10, further comprising holding the core with use of a chuck, wherein the thermocompression bonding is performed while holding the core with use of the chuck.

13. The method according to claim 12, wherein the thermocompression bonding includes supporting the projecting portion from a side opposite to a side of the flat surface.

14. The method according to claim 10, wherein the flat surface extends in a direction that is not orthogonal to a pressing direction of the heater chip, and the head surface of the heater chip extends in a direction that is orthogonal to the pressing direction of the heater chip.

15. The method according to claim 10, wherein the flat surface extends in a direction that is orthogonal to a pressing direction of the heater chip, and the head surface of the heater chip extends in a direction that is not orthogonal to the pressing direction of the heater chip.

16. The method according to claim 10, wherein the projecting portion has a lower-level surface that is located at a lower level than the flat surface, the lower-level surface is provided so as to traverse at least a part of the projecting portion in a direction perpendicular to the axial direction, and at least a part of the flat surface is present on the side of the front end of the projecting portion relative to the lower-level surface, and in the thermocompression bonding, an edge of the head surface of the heater chip on the side of the first flange portion or the second flange portion faces the lower-level surface.

17. The method according to claim 11, further comprising holding the core with use of a chuck, wherein the thermocompression bonding is performed while holding the core with use of the chuck.

18. The method according to claim 11, wherein the flat surface extends in a direction that is not orthogonal to a pressing direction of the heater chip, and the head surface of the heater chip extends in a direction that is orthogonal to the pressing direction of the heater chip.

19. The method according to claim 11, wherein the flat surface extends in a direction that is orthogonal to a pressing direction of the heater chip, and the head surface of the heater chip extends in a direction that is not orthogonal to the pressing direction of the heater chip.

20. The method according to claim 11, wherein the projecting portion has a lower-level surface that is located at a lower level than the flat surface, the lower-level surface is provided so as to traverse at least a part of the projecting portion in a direction perpendicular to the axial direction, and at least a part of the flat surface is present on the side of the front end of the projecting portion relative to the lower-level surface, and in the thermocompression bonding, an edge of the head surface of the heater chip on the side of the first flange portion or the second flange portion faces the lower-level surface.

* * * * *